US007412197B2

(12) United States Patent
Jang

(10) Patent No.: US 7,412,197 B2
(45) Date of Patent: Aug. 12, 2008

(54) HEAT ROLLER HAVING IMPROVED COUPLING STRUCTURE TO PREVENT SLIP OF A ROLLER CAP FOR FIXING APPARATUS

(75) Inventor: Jae-hyeok Jang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 154 days.

(21) Appl. No.: 11/410,054

(22) Filed: Apr. 25, 2006

(65) Prior Publication Data

US 2007/0098468 A1 May 3, 2007

(30) Foreign Application Priority Data

Nov. 2, 2005 (KR) ..... 10-2005-0104331

(51) Int. Cl.
*G03G 15/20* (2006.01)

(52) U.S. Cl. ..... 399/333; 219/216; 399/330

(58) Field of Classification Search ..... 399/333, 399/330, 328, 90; 219/216, 469; 347/156; 492/46, 47; 432/60; 70/174, 190
See application file for complete search history.

(56) References Cited

U.S. PATENT DOCUMENTS

| | | | | |
|---|---|---|---|---|
| 6,054,677 | A * | 4/2000 | Morigami et al. | 219/216 |
| 6,122,480 | A * | 9/2000 | Hwang | 399/328 X |
| 6,853,833 | B2 * | 2/2005 | Cho et al. | 399/330 |
| 6,983,118 | B2 * | 1/2006 | Jaskowiak et al. | 399/330 |
| 2003/0091374 | A1 * | 5/2003 | Lee et al. | 399/330 |
| 2004/0253026 | A1 | 12/2004 | Lee | 399/328 |
| 2005/0129434 | A1 * | 6/2005 | Kim | 399/330 |
| 2005/0129435 | A1 * | 6/2005 | Jaskowiak | 399/333 |
| 2006/0024098 | A1 * | 2/2006 | Tomatsu et al. | 399/333 |
| 2006/0291923 | A1 * | 12/2006 | Jang et al. | 399/333 |
| 2007/0065190 | A1 * | 3/2007 | Seol et al. | 399/328 |

FOREIGN PATENT DOCUMENTS

| | | |
|---|---|---|
| JP | 06-130872 | 5/1994 |
| JP | 06-342249 | 12/1994 |

(Continued)

OTHER PUBLICATIONS

English Abstract for Korean Patent Publication No. 1020040057775 dated Jul. 2, 2004.

(Continued)

*Primary Examiner*—Sophia S Chen
(74) *Attorney, Agent, or Firm*—Stein, McEwen & Bui, LLP

(57) ABSTRACT

A heat roller for a laser printer has a roller pipe, a resistive heat element accommodated in the roller pipe, an internal expanding pipe installed in the roller pipe which restricts the resistive heat element by pushing the resistive heat element toward the roller pipe, caps coupled to both end portions of the internal expanding pipe and provided with electrodes which supply a current to the resistive heat element, a gear coupled to any one of the caps, and a coupling unit which restricts at least one of the caps from slipping along the internal expanding pipe. The heat roller has the enhanced secure coupling between the internal expanding pipe, the roller pipe, the coil and the insulation layer. Accordingly, it is possible to prevent slip off and coil short circuit.

30 Claims, 6 Drawing Sheets

FOREIGN PATENT DOCUMENTS

| | | |
|---|---|---|
| JP | 08-305211 | 11/1996 |
| JP | 2003-280429 | 10/2003 |
| KR | 2003-303700 | 2/2003 |
| KR | 2004-35413 | 4/2004 |
| KR | 10-452874 | 10/2004 |
| KR | 2004-106754 | 12/2004 |

OTHER PUBLICATIONS

Office Action issued on Nov. 15, 2006 by the Korean Intellectual Property Office for Korean Patent Application No. 2005-104331.

Office Action issued Apr. 4, 2008 by the Chinese Patent Office with respect to Chinese Patent Application No. 200610082667.6

* cited by examiner

HEAT ROLLER HAVING IMPROVED COUPLING STRUCTURE TO PREVENT SLIP OF A ROLLER CAP FOR FIXING APPARATUS

CROSS-REFERENCE TO RELATED APPLICATIONS

This application claims benefit under 35 U.S.C. § 119(a) of Korean Patent Application No. 2005-104331 filed on Nov. 2, 2005 in the Korean Intellectual Property Office, the disclosure of which are incorporated herein by reference.

BACKGROUND OF THE INVENTION

1. Field of the Invention

Aspects of the present invention relate to a fixing apparatus of an image forming device. More particularly, aspects of the present invention relate to a heat roller for a fixing apparatus, having a coupling structure capable of preventing slip of a roller cap while the heat roller is driven.

2. Description of the Related Art

Generally, an image forming device, such as a laser printer or a copier, forms an image by printing out a desired image through a series of processes including electrification, exposure, development, transfer and fixing. The fixing process fixes a transferred toner image on a print medium, such as a paper sheet, a transparency, etc., by applying heat and pressure to the toner image, and is performed by using a pair of rollers facing each other.

The pair of rollers is a press roller and a heat roller. FIG. 1 illustrates the structure of a heat roller of the related art. Referring to FIG. 1, the heat roller 10 has a conductive cylindrical roller pipe 11, a resistive heat element 12 accommodated in the conductive cylindrical roller pipe 11, and caps 13 and 14 coupled to opposite ends of the conductive cylindrical roller pipe 11. A coating layer 18*a* is formed on the outer surface of the conductive cylindrical roller pipe 11. The resistive heating element 12 is generally an induction coil, and an insulation layer 18*c* may be interposed between the conductive cylindrical roller pipe 11 and the resistive heat element 12. The heat roller 10 also has an internal expanding pipe 16 which strongly pushes the resistive heat element 12 toward the roller pipe 11. The caps 13 and 14 are an end cap 13 and a gear cap 14, respectively. Each of these caps 13 and 14 has a connection terminal 15 and a Cu—Sn electrode 13*a* or 14*a*.

In the heat roller 10 structured as described above, current flows through the resistive heat element 12 via the electrodes 13*a* and 14*a* and the connection terminals 15 and 15 when alternative current (AC) from an AC power source is applied to carbon brushes 17*a* and 17*b* provided at opposite ends of the heat roller 10. As a result, energy which is generated due to resistant heating caused by the resistive heat element 12 is transferred to the roller pipe 11, which is an object to be heated, through the insulation layer 18*b*, and is further transferred to toner and the print medium through the roller pipe 11 and the coating layer 18*a*.

In the typical heat roller 10, the caps 13 and 14, particularly the gear cap 14, are released from the heat roller pipe 11 if the caps 13 and 14 are not securely coupled to the ends of the heat roller pipe 11, which results in twisting of the connection terminals 15, and can cause a failure, such as a short circuit. Accordingly, the caps 13 and 14 need to be securely fixed to the ends of the heat roller pipe 11.

FIG. 2 is an exploded perspective view of the gear cap 14 of the heat roller shown in FIG. 1. Referring to FIG. 2, the gear cap 14 has male screw threads 14*b* which can be securely mated with female screw threads 11*b* formed on the inner surface of the heat roller pipe 11. Even though the end cap 13 is not shown in FIG. 2, the end cap 13 is also screw mated with the heat roller pipe 11.

However, in the heat roller for a fixing apparatus as described above, even if the gear cap 14 is coupled with the heat roller pipe 11 by a screw coupling manner, the gear cap 14 can slip off the heat roller pipe 11 during counter rotation. When the gear cap 14 slips off the heat roller pipe 11, the connection terminals 15 and 15 for connecting the electrodes 13*a* and 14*a* with the resistive heat element 12 become twisted, causing a short circuit. Additionally, the heat roller pipe has a diameter of about 1 mm so that height of the female screw threads formed on the inner surface of the heat roller pipe is about 0.35 mm at most. Accordingly, if torque is too high, the screw threads are demolished, resulting in rotating of the gear cap. This rotating can cause a variety of problems, including a short circuit, contact failure, sparking, and so on.

In order to solve the above described and/or other problems, the applicant of the present invention suggested a heat roller for a fixing apparatus, in which a gear cap does not have screw threads but is coupled to a heat roller pipe by a different coupling device other than the screw configuration. Such a heat roller is disclosed in Korean Patent Registration No. 452,874.

FIG. 3 and FIG. 4 illustrate the structure of the coupling device of the gear cap and the heat roller pipe disclosed in the above literature. Particularly, FIG. 3 is an exploded perspective view and FIG. 4 is a sectional view. Referring to FIG. 3, a gear cap 24 is coupled to an end portion of a heat roller pipe 21 by a fixing ring 30 and a latch projection 32*a*. The fixing ring 30 restricts the gear cap 24 from slipping off the heat roller pipe 21 in the axial direction of the heat roller pipe 21, and the latch projection 32*a* received in an engagement groove 31*a* restricts the gear cap 24, which is restricted in the axial direction, from slipping the heat roller pipe 21 in the rotational direction.

The above described coupling structure of the gear cap 24 has a greater coupling force than the screw coupling configuration. However, in the situation when the heat roller 20 is applied to a high speed printer, the following problem occurs. When inertial force of the heat roller 20 is greater than the expanding pressure of an internal expanding pipe 26, the internal expanding pipe 26 slips in the rotational direction, thereby causing the resistive heat element 22 and an insulation layer 28*b* to slip off, and causing a short circuit after the heat roller 20 repeatedly performs the operations of rotating and stopping at high speed. The internal expanding pipe 26 of the above described heat roller 20 has expansivity higher than that of an insulative mica. Accordingly, an image forming device including a heat roller such as heat roller 20 repeatedly performs the operations of heating and cooling corresponding to the times when a user turns the image forming device on and off. In this instance, since the cap 24 is coupled only by the fixing ring 30, the internal expanding pipe 26 can slip, thereby causing a short circuit of an induction coil, which is the resistive heat element 22.

SUMMARY OF THE INVENTION

An aspect of the present invention is to solve at least the above and/or other problems and/or disadvantages and to provide at least the advantages described below. Accordingly, an aspect of the present invention is to provide a heat roller for a fixing apparatus, in which a cap and an internal expanding pipe are coupled together, thereby preventing drift between the internal expanding pipe and the cap, or slipping of the cap, and further preventing a short circuit between a resistive heat element and a connection terminal.

Another aspect of the present invention is to provide a heat roller for a fixing apparatus, in which a gear cap is divided into a cap and a gear and the gear and the cap are assembled to serve as the gear cap, thereby enhancing the coupling force between the cap and the internal expanding pipe, which results in prevention of drifting or slipping of the roller pipe, the cap and the internal expanding pipe, and avoids twisting of a coil, which could cause a short circuit.

According to one embodiment proposed to achieve the above-described aspect, there is provided a heat roller for a fixing apparatus, comprising a roller pipe, a resistive heat element accommodated in the roller pipe, an internal expanding pipe installed in the roller pipe which restricts the resistive heat element by pushing the resistive heat element toward the roller pipe, caps coupled to opposite end portions of the internal expanding pipe and provided with corresponding electrodes which supply a current to the resistive heat element, a gear coupled to any one of the caps, and a coupling unit which presses an inner surface of the internal expanding pipe towards the roller pipe.

In the heat roller for a fixing apparatus, it is preferable that the coupling unit is an elastic member installed in a station groove provided in at least one of the caps and installed in close contact with an inner surface of the internal expanding pipe. The elastic member may be a spring plate. A plurality of the elastic members can be installed in the cap, facing each other.

It is preferable that the gear has a projection mated with the roller pipe, on a side surface thereof, and the roller pipe has a coupling groove mated with the projection, at an end portion thereof.

In addition, it is preferable that the gear has a coupling projection on an inner surface thereof so as to be coupled with the cap, and the cap has an insertion groove at an outer surface thereof so as to be coupled with the coupling projection.

It is preferable that the caps and electrodes are coupled by an engagement member.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
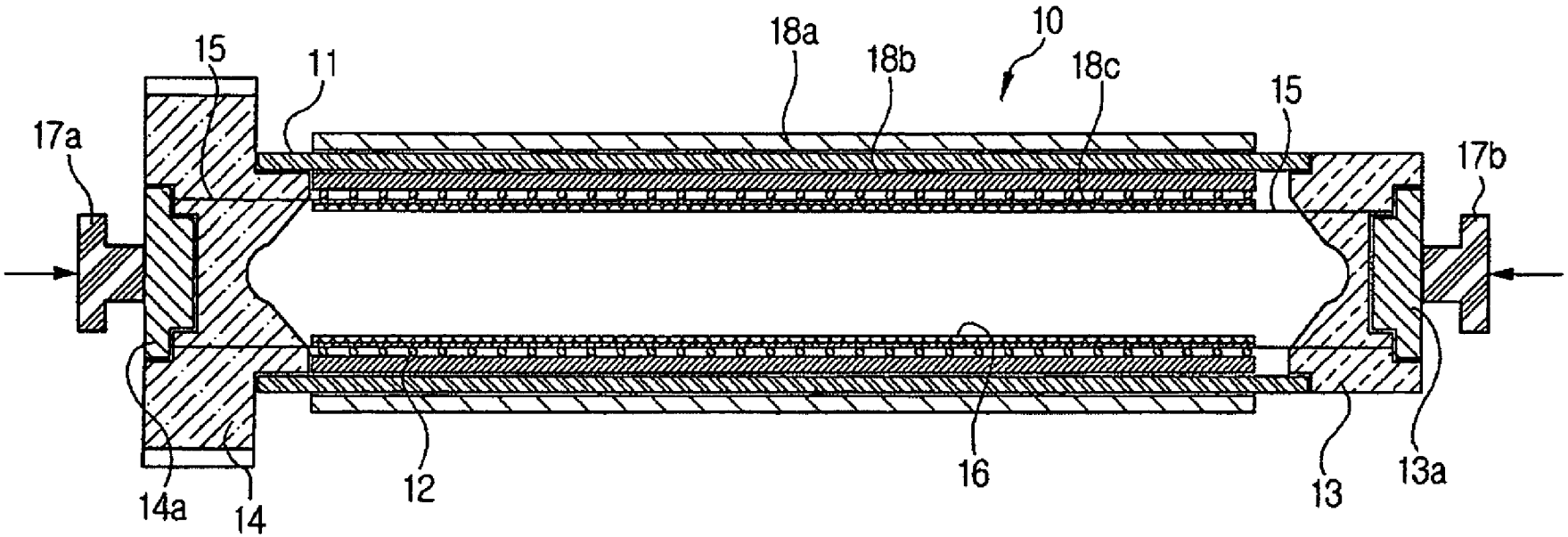
FIG. 1 (PRIOR ART)
FIG. 1 is a sectional view illustrating the structure of a heat roller of the related art.
Figure 2:
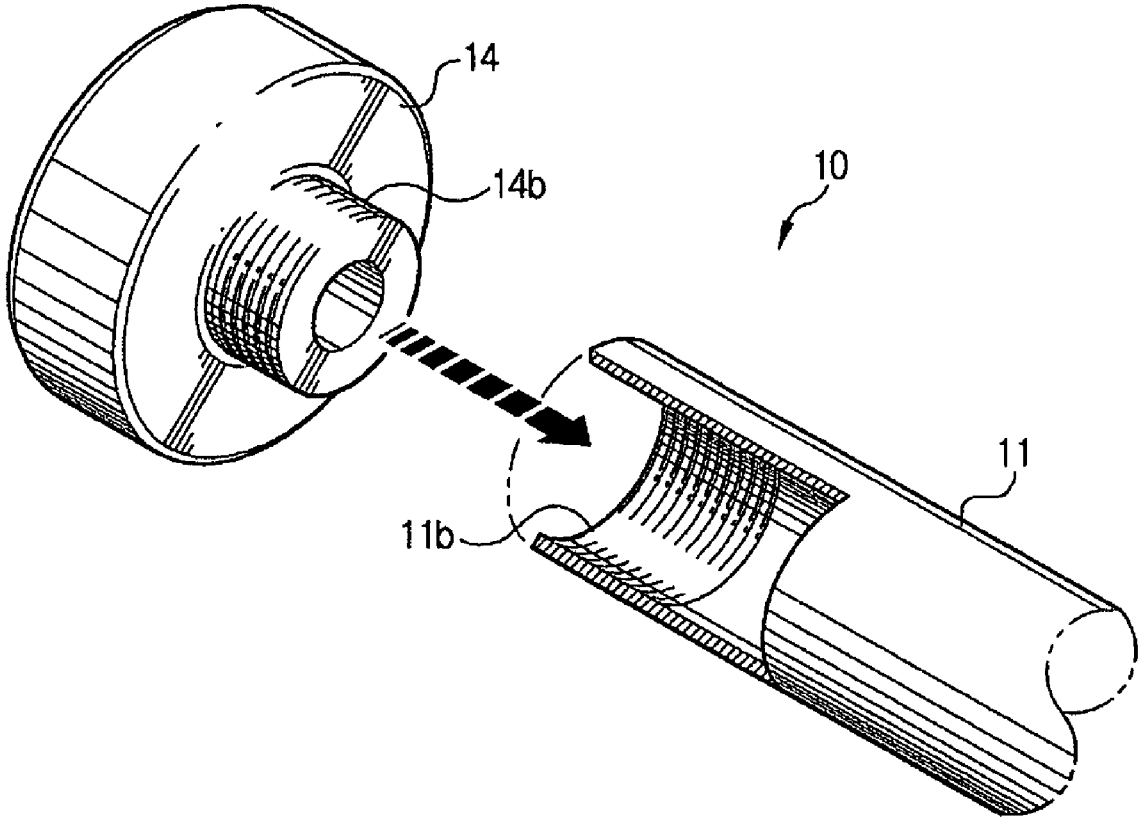
FIG. 2 (PRIOR ART)
FIG. 2 is an exploded perspective view illustrating a gear cap and a coupling structure of the heat roller shown in FIG. 1.
Figure 3:
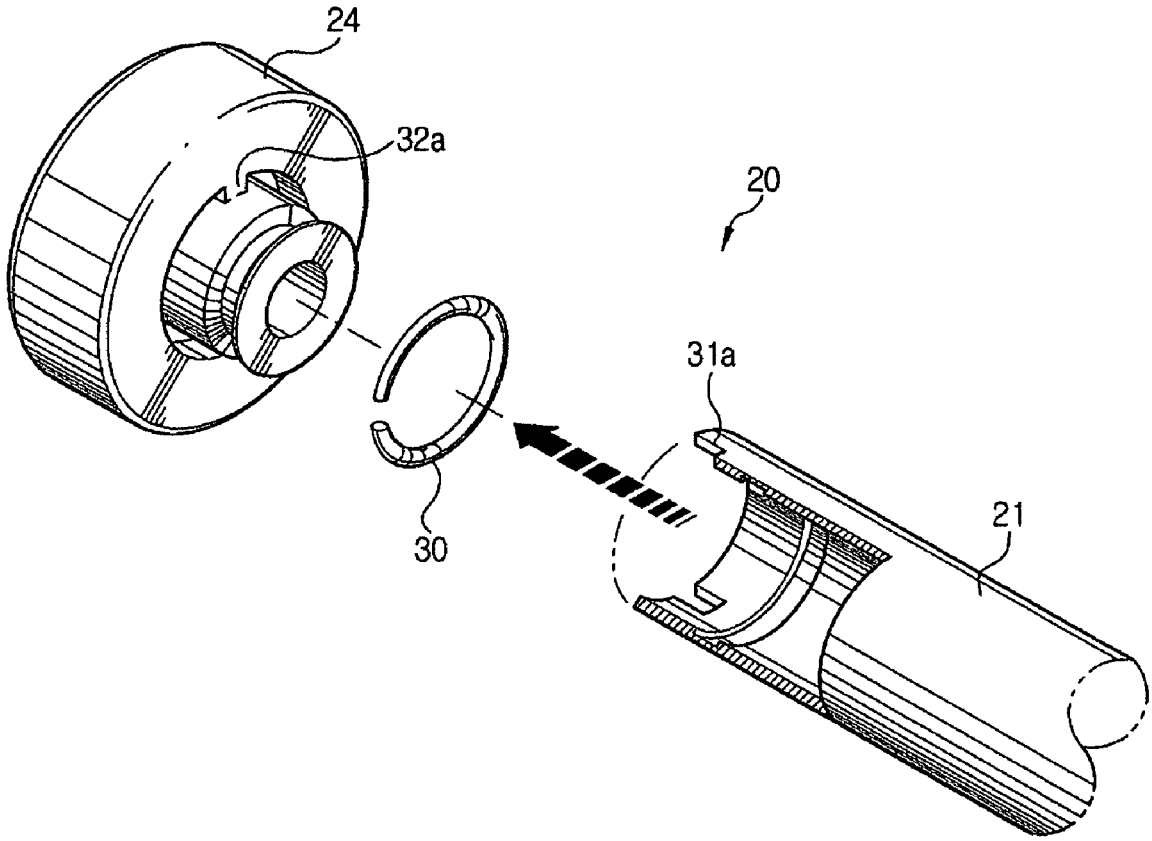
FIG. 3 (PRIOR ART)
FIG. 3 is an exploded perspective view illustrating a gear cap and a coupling structure of a heat roller according to another embodiment of the related art.
Figure 4:
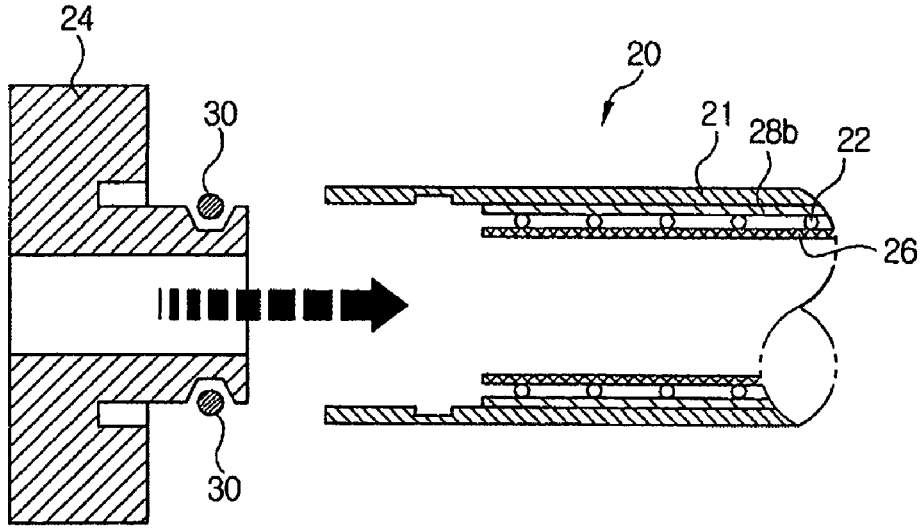
FIG. 4 (PRIOR ART)
FIG. 4 is a sectional view illustrating the gear cap and the coupling structure shown in FIG. 3.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 5:
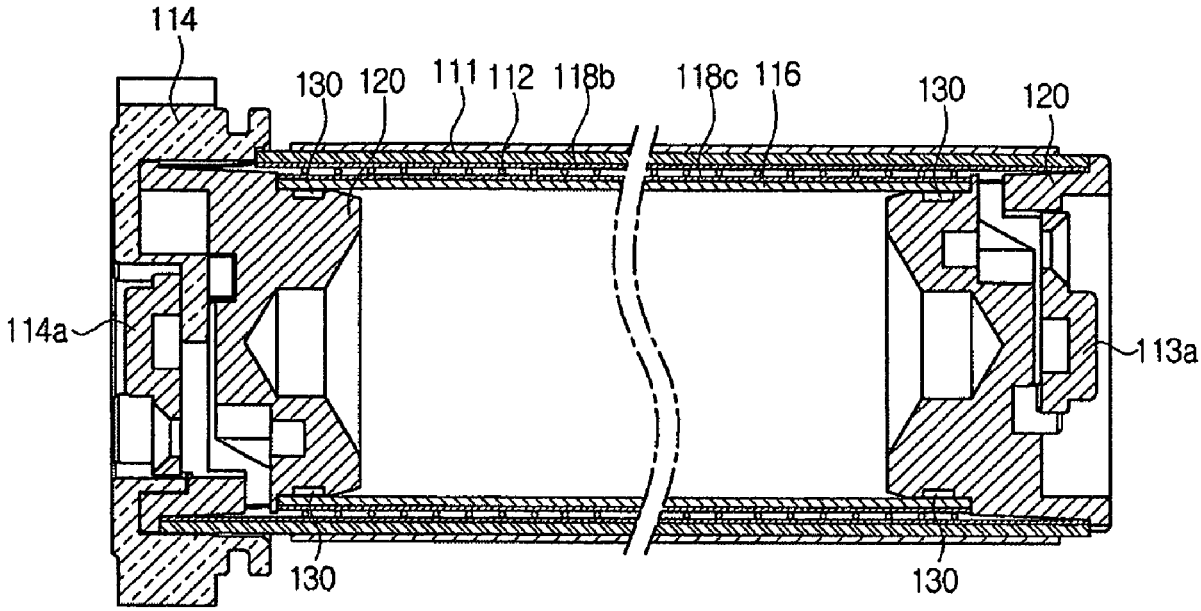
FIG. 5 is a sectional view of a heat roller according to an embodiment of the present invention.
Figure 6:
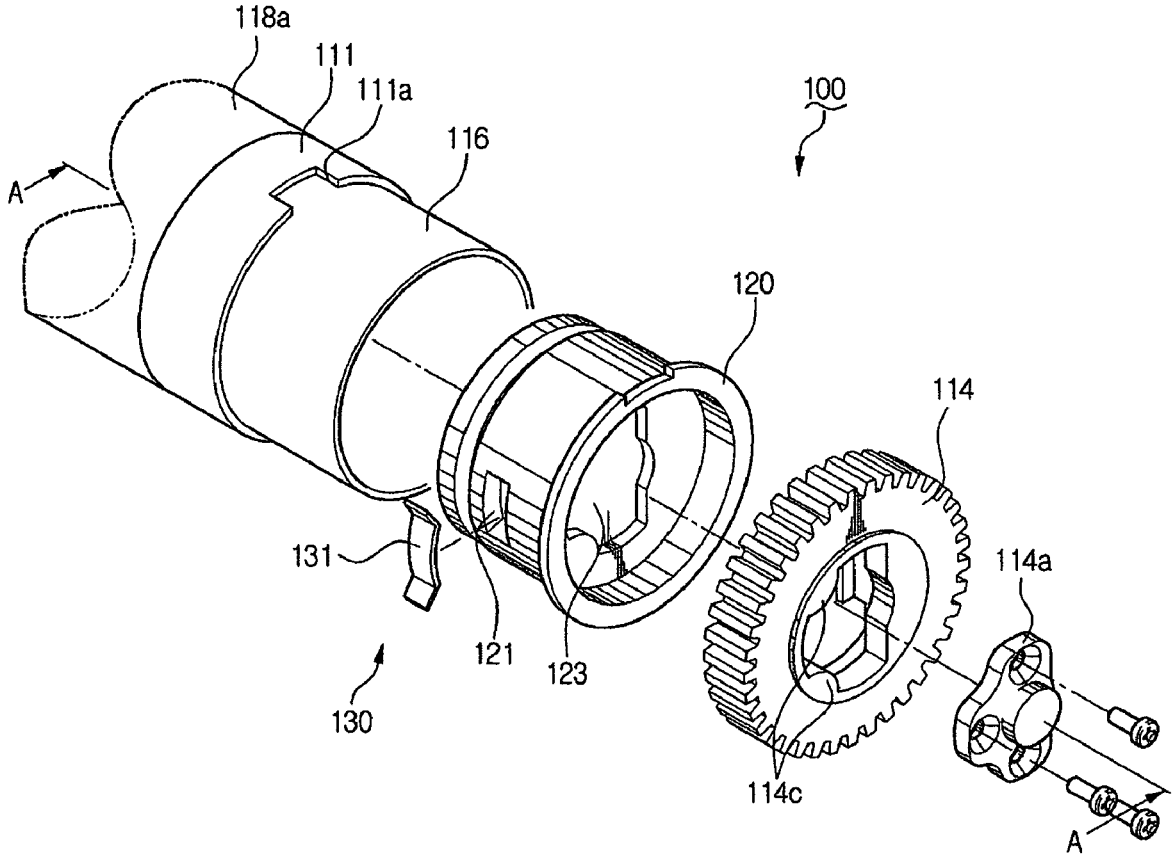
FIG. 6 is an exploded perspective view illustrating a gear cap and a heat roller shown in FIG. 5.

FIG. 5 is a sectional view of the heat roller according to one embodiment of the present invention, in which the sectional view is taken along a line A-A in FIG. 6, and FIG. 6 is an exploded perspective view of the heat roller.

Referring to FIG. 5, the heat roller comprises a roller pipe 111, a resistive heat element 112, an internal expanding pipe 116, a pair of caps 120, a gear 114 and a coupling unit 130, also referred to as a locking unit.

The roller pipe 111 is made of a conductive material, such as steel, aluminum or copper and formed like a hollow cylinder. The roller pipe 111 is provided with a coating layer 118*a* on the outer surface thereof and an insulation layer 118*b* on the inner surface thereof. The coating layer 118*a* is formed of a fluorine-based release layer, such as PFA or PTFE, in order to facilitate separation of the toner and/or the print medium. The coating layer 118*a* is not limited to PFA or PTFE. Additionally, the print medium may include paper, transparencies, overheads, etc. The insulation layer 118*b* is formed of the same material as the coating layer 118*a*, or may be formed from mica, for electrically insulating the roller pipe 111 from the resistive heat element 112. The coating layer 118*a* and the insulation layer 118*b* are well known elements, so a more detailed description thereon will be omitted.

The resistive heat element 112 is accommodated in the roller pipe 111 and is formed as an induction coil which winds along the inner surface of the roller pipe 111. The induction coil can be made of copper, nickel-chrome alloy, or iron-chrome alloy. However, the induction coil may also be made of other materials, and is not limited to being made of copper, nickel-chrome alloy, or iron-chrome alloy. The induction coil is generally coated with a ceramic material, such as enamel, glass, or alumina ($Al_2O_3$), or an insulation material, such as silicon rubber, so that it is electrically insulated.

The internal expanding pipe 116 is installed in the roller pipe 111 and functions to restrict the resistive heat element 112 by pushing the resistive heat element 112 toward the roller pipe 111. Due to the internal expanding pipe 116, the roller pipe 111, the resistive heat element 112 and the insulation layer 118*b* can be in close contact with each other. The internal expanding pipe 116 is made of aluminum or stainless steel. Further, an additional insulation layer 118*c* can be interposed between the resistive heat element 112 and the internal expanding pipe 116.

The caps 120 are coupled to both end portions of the internal expanding pipe 116, and are also engaged with electrodes 113*a* and 114*a* for supplying a current to the resistive heat element 112. The electrodes 113*a* and 114*a* are made of Cu—Su and are installed such that they can transfer a current supplied from a carbon brush while the heat roller 100 rotates the resistive heat element 112. The electrodes 113*a* and 114*a* are inserted into the caps 120 and 120. Referring to FIG. 6, the electrodes 113*a* and 114*a* (not shown) are engaged with the caps 120 and 120 (not shown) by a coupling unit, such as, for example, a screw.

The gear 114 is coupled to either of the caps 120 and 120, for example, to the left cap 120 in FIG. 5. The gear 114 is connected to a drive gear of a motor or a transfer gear chain (not shown) and thus drives the heat roller 100.

The coupling unit 130 is installed in the heat roller 100 for preventing one or both of the pair of the caps 120 from slipping along the internal expanding pipe 116 in the axial direction and from slipping along the internal expanding pipe 116 in the axial direction.

The coupling unit 130 may be an elastic member 131 which is installed in a station groove 121 provided in the cap 120, so that it is in close contact with the inner surface of the internal expanding pipe 116. The elastic member 131 may be preferably a spring plate. Each of the caps 120 and 120 may accommodate a plurality of the spring plates 131, for example, two plates facing each other. The spring plates 131 push the inner surface of the internal expanding pipe 116 by a spring force toward the outside of the internal expanding pipe 116, thereby locking the internal expanding pipe 116 into place. As a result, drifting or slipping of the caps 120 in the axial or rotational direction does not occur in the internal expanding pipe 116 while the heat roller 100 repeatedly performs the operations of rotating and stopping at a high temperature.

The heat roller 100 can further comprise a projection (114*b* in FIG. 7) at a side surface of the gear 114 so that the gear 114 can be sufficiently engaged with the roller pipe 111. In such a case, the roller pipe 111 has a coupling groove 111*a* at an end portion thereof so as to mate with the projection 114*b*. Due to the coupling of the projection 114*b* of the gear 114 and the coupling groove 111*a* of the roller pipe 111, drifting or slipping off of the heat roller 100 does not occur and the gear 114 and the roller pipe 111 are not separated from each other during the operation of the heating roller 100.

According to one embodiment of the present invention, the inner surface of the gear 114 may be formed into a variety of shapes so as to be engaged with the caps 120 in the heat roller 100. For example, as shown in FIG. 6, the inner surface of the gear 114 may have a plurality of coupling projections 114*c* thereon. In this instance, the cap 120 is provided with a plurality of insertion grooves 123 to be mated with the coupling projections 114*c*, on the outer surface thereof. Through the coupling of the coupling projections 114*c* and the insertion grooves 123, the gear 114 and the cap 120 are securely coupled so that drifting and/or slipping does not occur.

In the above described heat roller 100, a gear cap comprised of the cap 120 and the gear 114, is distinct from and improved over the gear cap 14 of the heat roller 10 in the related art. Accordingly, the cap 120 can be easily coupled with the internal expanding pipe 116 and the gear 114 can be easily coupled with the roller pipe 111. In other words, the cap 120 increases the strength of the coupling of the internal expanding pipe 116, and the gear 114 increases the strength of the coupling with the roller pipe 111. That is, the cap 120 and the gear 114 can be securely coupled due to the engagement of the coupling projections 114*c* and the insertion grooves 123.

Thus, in the heat roller 100 according to one embodiment of the present invention, since the electrodes 113*a* and 114*a*, the caps 120 and the gears 114 are engaged by the engagement member, the cap 120 and the internal expanding pipe 116 are coupled by the coupling unit 130, and the engagement grooves 111*a* of the roller pipe 111 are mated with the projections 114*b* of the gear 114, drifting and/or slipping does not happen to any of these components of the heat roller 100.

Figure 7:
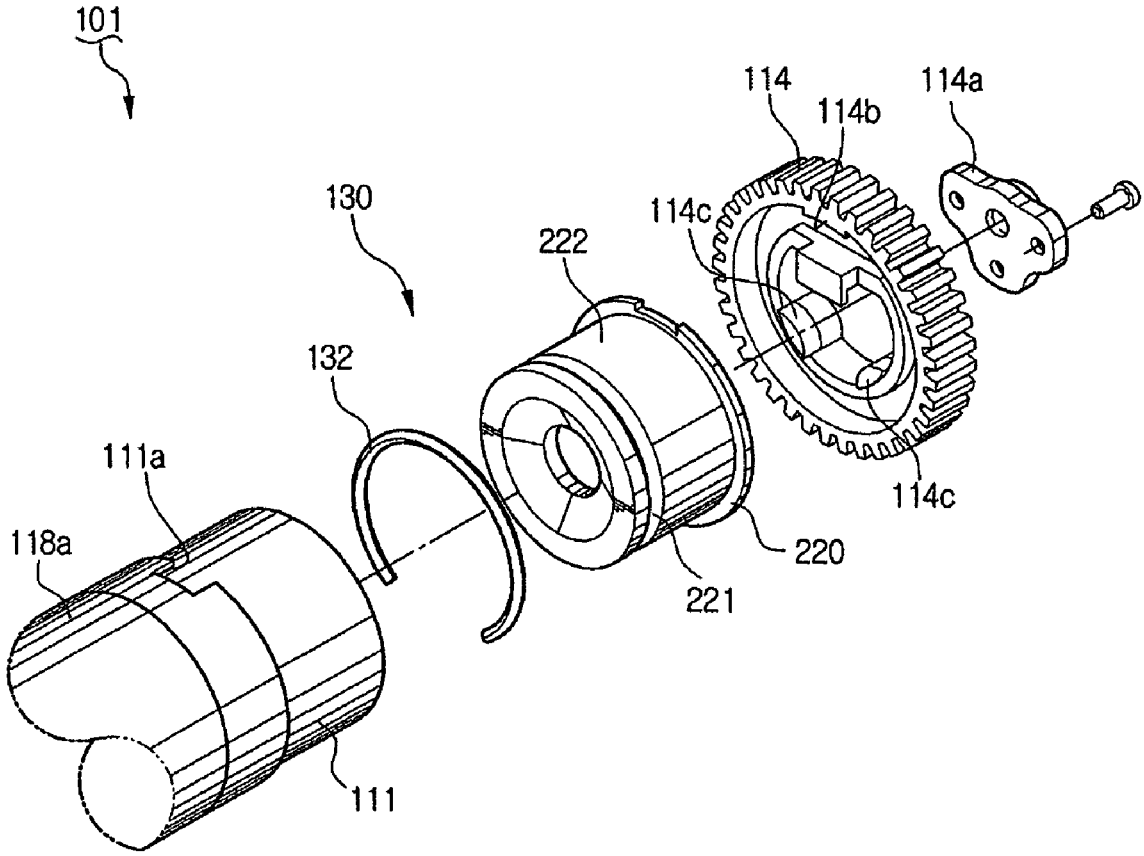
FIG. 7 is a sectional view of a gear cap and a coupling structure of a heat roller according to another embodiment of the present invention.

FIG. 7 is an exploded perspective view of a cap 220 of a heat roller according to another embodiment of the present invention. The heat roller 101 shown in FIG. 7 has the same structure as the heat roller 100 according to one embodiment, except for the coupling unit 130 which couples the internal expanding pipe 116 and the gear 114 with the cap 220. Accordingly, like elements and members are denoted by like reference symbols and repetitive descriptions of the like elements are omitted.

The coupling unit 130 of a heat roller 101 according to another embodiment of the present invention comprises a fixing ring 132 serving as the elastic member. Further, a cap 220 has a station groove 221 structured to correspond to the fixing ring 132 on the outer surface 222 thereof to receive the fixing ring 132 therein. The fixing ring 132 is a C-shaped ring having a partially cut away portion and is elastically biased radially outwardly against the inner surface of internal expanding pipe 116. Accordingly, the station groove 221 has a shape corresponding to the shape of the fixing ring 132.

The fixing ring 132 pushes the inner surface of the internal expanding pipe 116 by a spring force toward the outside of the internal expanding pipe 116, and thereby the cap 220 and the internal expanding pipe 116 are securely coupled, so the cap 220 does not drift or slip off or around the internal expanding pipe 116.

The elastic member used in the coupling unit may be made of an elastic material having elasticity, such as steel, steel alloy or stainless steel. Other materials may also be used in the elastic member.

As described above, according to aspects of the present invention, the gear cap is formed by assembling the gear and the cap which are separate components, thereby enhancing the coupling force between the cap and the internal expanding pipe, and also enhancing the coupling force between the gear and the roller pipe, which prevents drifting or slipping between the components, such as the roller pipe, the cap, the gear and the internally extended pipe.

In a case where the heat roller according to the embodiments of the present invention is applied to a high speed printer, the coupling unit can supplement the expandability of the internal expanding pipe and support the internal expanding pipe, thereby preventing slippage of the internal expanding pipe, twisting of the coil in the resistive heat element, and short circuits.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A heat roller for a fixing apparatus, comprising:

a roller pipe;

a resistive heat element housed in the roller pipe;

an internal expanding pipe housed in the roller pipe which presses the resistive heat element against the roller pipe;

caps coupled to opposite end portions of the internal expanding pipe and provided with electrodes which supply a current to the resistive heat element;

a gear coupled to one of the caps; and a coupling unit which presses the internal expanding pipe towards the roller pipe.

2. The heat roller for a fixing apparatus according to claim 1, wherein the coupling unit is an elastic member installed in a station groove formed in at least one of the caps and makes contact with an inner surface of the internal expanding pipe.

3. The heat roller for a fixing apparatus according to claim 2, wherein the elastic member is a spring plate.

4. The heat roller for a fixing apparatus according to claim 3, wherein a plurality of the elastic members are installed in each of the caps.

5. The heat roller for a fixing apparatus according to claim 4, wherein the elastic members are positioned across from each other.

6. The heat roller for a fixing apparatus according to claim 2, wherein the elastic member is a fixing ring having a partially cut away portion.

7. The heat roller for a fixing apparatus according to claim 6, wherein the fixing ring is installed in the station groove formed in at least one of the caps.

8. The heat roller for a fixing apparatus according to claim 1, further comprising:

a coupling projection on the gear; and a coupling groove on a side surface of the roller pipe, wherein the projection engages the coupling groove and thereby prevents the gear from slipping in relation to the roller pipe.

9. The heat roller for a fixing apparatus according to claim 1, further comprising:

a coupling projection on an inner surface of the gear; and an insertion groove at an outer surface of one of the caps, wherein the projection engages the insertion groove and thereby prevents the gear from slipping in relation to the cap.

10. The heat roller for a fixing apparatus according to claim 1, further comprising:

a coupling projection on an inner surface of the gear; and an insertion groove at an outer surface of at least one of the caps, wherein the projection engages the insertion groove, and thereby prevents the gear from slipping in relation to the cap.

11. The heat roller for a fixing apparatus according to claim 10, wherein the caps and electrodes are coupled by an engagement member.

12. The heat roller for a fixing apparatus according to claim 11, wherein the engagement member is a screw.

13. The heat roller for a fixing apparatus according to claim 1, wherein the caps and electrodes are coupled by an engagement member.

14. The heat roller for a fixing apparatus according to claim 13, wherein the engagement member is a screw.

15. A heat roller for a fixing apparatus, comprising:

a conductive cylindrical roller pipe;

an induction coil housed in the conductive cylindrical roller pipe;

an internal expanding pipe installed in the conductive cylindrical roller pipe which presses the induction coil toward the conductive cylindrical roller pipe;

a gear coupled to an end of the internal expanding pipe and provided with a first electrode which supplies a current to the induction coil;

an end cap coupled to an other end of the roller pipe and provided with a second electrode; and a coupling unit which prevents the end cap from slipping in relation to the internal expanding pipe in an axial or rotational direction of the internal expanding pipe.

16. The heat roller for a fixing apparatus according to claim 15, wherein the coupling unit is an elastic member installed in a station groove formed in the end cap.

17. The heat roller according to claim 16, wherein the elastic member is a spring plate.

18. The heat roller for a fixing apparatus according to claim 16, wherein the elastic member is a fixing ring.

19. The heat roller for a fixing apparatus according to claim 18, wherein the fixing ring has a partially cut away portion which engages a protrusion on the station groove.

20. The heat roller for a fixing apparatus according to claim 15, further comprising:

a coupling projection on the gear; and a coupling groove on a side surface of the roller pipe, wherein the coupling projection engages the coupling groove and thereby prevents the gear from slipping in relation to the roller pipe.

21. The heat roller for a fixing apparatus according to claim 15, further comprising:

a coupling projection on an inner surface of the gear; and an insertion groove at an outer surface of the end cap, wherein the coupling projection engages the insertion groove and thereby prevents the gear from slipping in relation to the cap.

22. The heat roller for a fixing apparatus according to claim 21, wherein the end cap and the second electrodes are coupled by an engagement member.

23. The heat roller for a fixing apparatus according to claim 22, wherein the engagement member is a screw.

24. The heat roller according to claim 15, wherein the end cap and the second electrode are coupled by an engagement member.

25. The heat roller for a fixing apparatus according to claim 24, wherein the engagement member is a screw.

26. A heat roller for a fixing apparatus, comprising:

a roller pipe;

a resistive heat element housed in the roller pipe;

an internal expanding pipe housed in the roller pipe which presses the resistive heat element against the roller pipe; and a locking unit which forces the internal expanding pipe against the roller pipe and thereby prevents the resistive heat element from twisting.

27. The heat roller for a fixing apparatus according to claim 26, further comprising:

a gear connected to the roller pipe which rotates the roller pipe; and a cap connected to the gear, wherein the locking unit is an elastic member installed in a station groove formed in the cap.

28. The heat roller for a fixing apparatus according to claim 27, wherein the elastic member is a spring plate.

29. The heat roller for a fixing apparatus according to claim 27, wherein the elastic member is a fixing ring having a partially cut away portion.

30. The heat roller for a fixing apparatus according to claim 29, wherein the fixing ring is installed in the station groove formed in the cap.

* * * * *